US011348714B2

(12) United States Patent
Goeders

(10) Patent No.: US 11,348,714 B2
(45) Date of Patent: May 31, 2022

(54) MAGNETIC MEMBER

(71) Applicant: Jon Jay Goeders, Kirkwood, MO (US)

(72) Inventor: Jon Jay Goeders, Kirkwood, MO (US)

( * ) Notice: Subject to any disclaimer, the term of this patent is extended or adjusted under 35 U.S.C. 154(b) by 0 days.

(21) Appl. No.: 16/821,189

(22) Filed: Mar. 17, 2020

(65) Prior Publication Data

US 2021/0296035 A1 Sep. 23, 2021

(51) Int. Cl.
*H01F 7/02* (2006.01)
*H01F 1/00* (2006.01)

(52) U.S. Cl.
CPC ..... *H01F 7/0252* (2013.01); *H01F 1/0018* (2013.01); *H01F 7/021* (2013.01)

(58) Field of Classification Search
CPC ..... H01F 7/021; H01F 7/0252; H01F 1/0018
See application file for complete search history.

(56) References Cited

U.S. PATENT DOCUMENTS 6,431,513 B1 * 8/2002 Rosen ..... B43M 99/009 248/309.4
9,343,214 B2 * 5/2016 Mathieu ..... A45F 5/02
2004/0173484 A1 * 9/2004 Bates ..... A41D 13/0012 206/349
2015/0159425 A1 * 6/2015 Algar ..... E06B 3/285 52/202

* cited by examiner

*Primary Examiner* — Mohamad A Musleh
(74) *Attorney, Agent, or Firm* — Zarley Law Firm P.L.C.

(57) ABSTRACT

A magnetic member for attachment to a surface has a first layer of material connected to a second layer of material and a plurality of spaced metal strips or metal particles are disposed between the first and second layers of material. The spaced metal strips or metal particles are adapted to magnetically attract a magnetic material attached to an object.

6 Claims, 2 Drawing Sheets

MAGNETIC MEMBER

BACKGROUND OF THE INVENTION

The present invention is directed to a magnetic member and more particularly a magnetic member for holding objects in place when vibration is present from earthquakes or moving vehicles.

Displaying collectables in display shelves is well-known. However, in the event of mild earthquakes the vibrations can cause the collectables to fall and break. Likewise, in vehicles, such as motor homes, boats, and other vehicles, during operations, it is difficult to set objects down such as drinks, or maintain objects in shelves, without the objects moving or falling. Therefore, a need exists in the art for a device that will address these deficiencies.

An objective of the present invention is to provide a magnetic member that holds objects in place during an earthquake.

Another objective of the present invention is to provide a magnetic member that holds an object in place in a moving vehicle.

These and other objectives will be apparent to those having ordinary skill in the art based upon the following written description, drawings and claims.

SUMMARY OF THE INVENTION

A magnetic member has a first layer of material connected to a second layer of material. Disposed between the two layers are a plurality of spaced metal strips or metal particles. Attached to an outer surface of the second layer of material is adhesive used to attach the magnetic member to a surface.

When an object, having a layer of magnetic material attached to the object, is placed on an outer surface of the first layer of material, the layer of magnetic material magnetically attracts the spaced metal strips or metal particles holding the object in place in relation to the magnetic member and the surface.

DETAILED DESCRIPTION OF THE PREFERRED EMBODIMENTS

Figure 1:
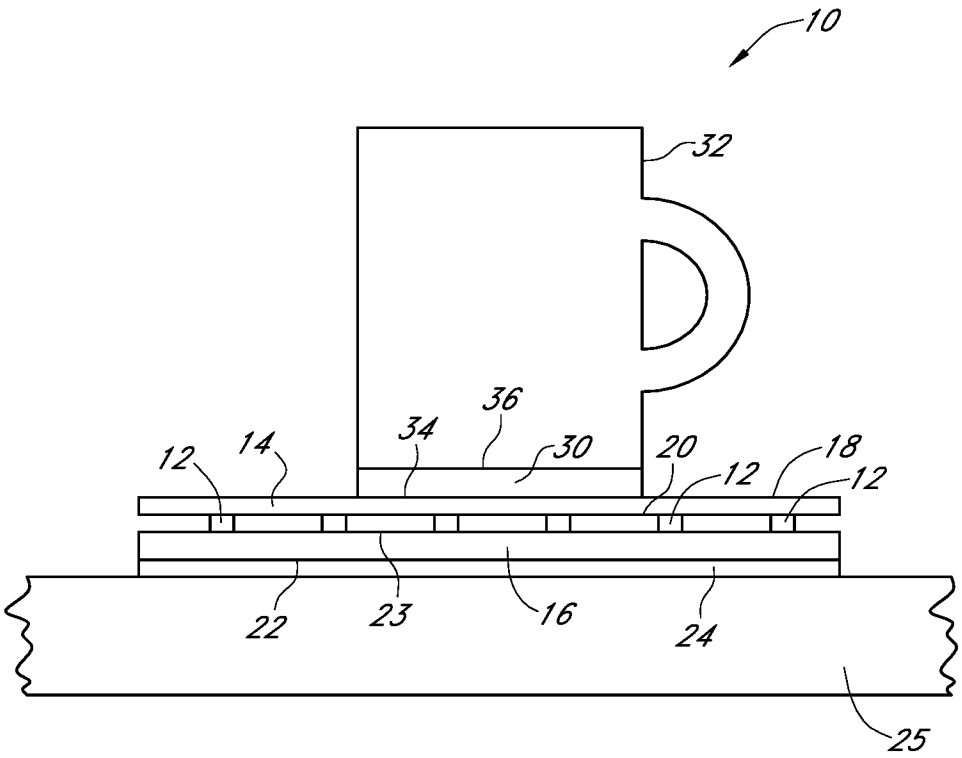
FIG. 1 is a side sectional view of a magnetic member.
Figure 2:
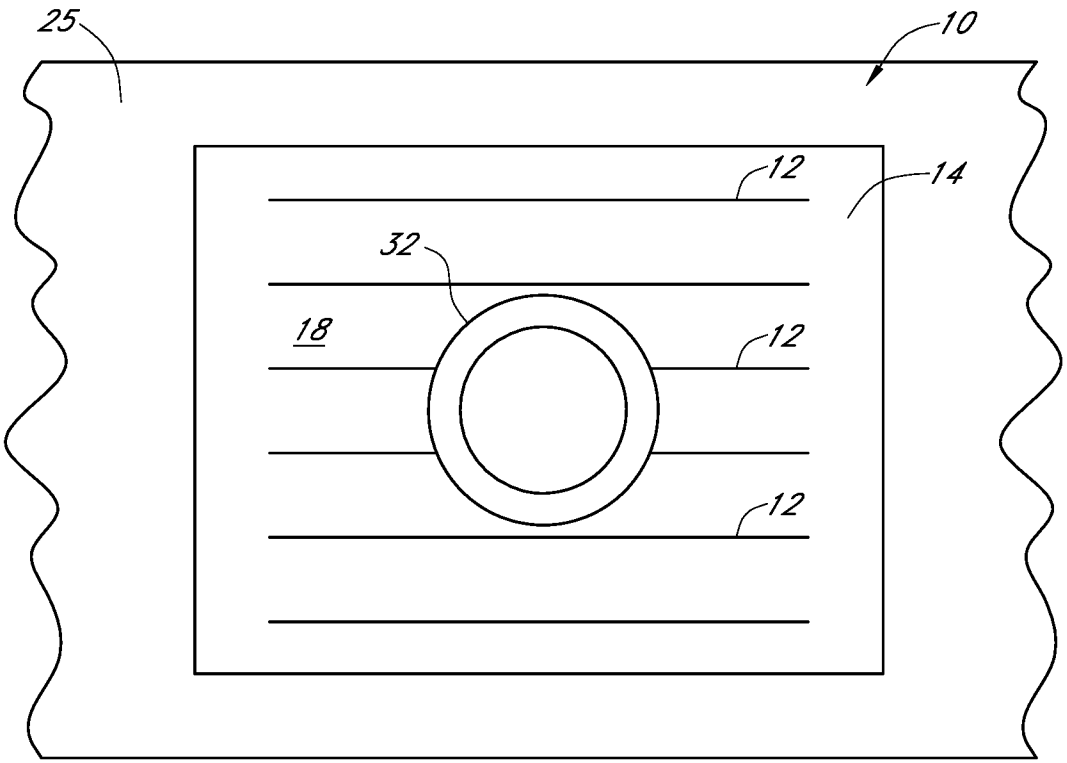
FIG. 2 is a top plan view of a magnetic member.

Referring to the Figures, a magnetic shelf member 10 has a plurality of spaced metal strips 12 disposed between a first layer of material 14 and a second layer of material 16. The first 14 and second 16 layer of material are made of any material, and preferably are made of a clear plastic material.

The first layer 14 has a first or outer surface 18 and a second or inner surface 20 that engages the metal strips 12. The second layer 16 has a first or outer surface 22 and a second or inner surface 23 that engages the metal strips 12. Alternatively, metal particles 12 are used. The first 14 and second 16 layer are connected through lamination, infusion or the like. Attached to the outer surface 22 of the second layer 16 is adhesive 24.

In operation, the magnetic shelf member 10 is cut to fit a surface 25 such as a shelf, dashboard, console, or the like. A cover 28, placed over the adhesive 24 is removed and the magnetic shelf member 10 is placed on the shelf surface 25 such that the adhesive 24 engages the shelf surface 25 holding the magnetic shelf member 10 in place.

A layer of magnetic material 30 is cut to fit the base of an object 32 such as a glass or the like. The layer of magnetic material 30 has a first magnetic surface 34 and second adhesive surface 36. The adhesive surface 36 is attached to the bottom of the object 32. The object 32 is then placed on the magnetic shelf member 10 with the magnetic surface 34 engaging the outer surface 18 of the first layer 14. The magnetic surface 34 attracts the metal strips 12 with enough magnetic force to hold the object 32 in place if and when the surface 25 experiences unstable movements.

Accordingly, a magnetic shelf member 10 has been disclosed that at the very least meets all the stated objectives.

From the above discussion and accompanying figures and claims it will be appreciated that the magnetic shelf member 10 offers many advantages over the prior art. It will be appreciated further by those skilled in the art that other various modifications could be made to the device without parting from the spirit and scope of this invention. All such modifications and changes fall within the scope of the claims and are intended to be covered thereby. It should be understood that the examples and embodiments described herein are for illustrative purposes only and that various modifications or changes in the light thereof will be suggested to persons skilled in the art and are to be included in the spirit and purview of this application.

What is claimed is:

1. A magnetic member for attachment to a surface, comprising:

a first layer of material connected to a second layer of material;

a plurality of spaced metal strips disposed between the first layer of material and the second layer of material, adhesive attached to an outer surface of the second layer;

a layer of magnetic material having a magnetic surface and an adhesive surface, adhesively connected to an object; and wherein an outer surface of the first layer of material engages the layer of magnetic material in a manner that attracts the spaced metal strips.

2. The member of claim 1 wherein the first and second layers of material are laminated together.

3. The member of claim 1 wherein the first and second layers of material are made of clear plastic.

4. The member of claim 1 wherein the adhesive engages and is connected to the surface.

5. The member of claim 4 wherein the surface is one selected from a group consisting of a shelf, a dashboard, and a console.

6. The member of claim 1 wherein the adhesive is attached to the outer surface of the second layer.

* * * * *